US006336456B1

(12) United States Patent
Ruben

(10) Patent No.: US 6,336,456 B1
(45) Date of Patent: Jan. 8, 2002

(54) SURGICAL MASK WITH NASAL DILATOR

(76) Inventor: Philip H. Ruben, 9201 Sunset Blvd., Los Angeles, CA (US) 90069

( * ) Notice: Subject to any disclaimer, the term of this patent is extended or adjusted under 35 U.S.C. 154(b) by 0 days.

(21) Appl. No.: 09/316,312

(22) Filed: May 21, 1999

(51) Int. Cl.[7] ..... A62B 7/10

(52) U.S. Cl. ..... 128/206.19; 128/200.24; 606/199

(58) Field of Search ..... 128/200.24, 207.18, 128/204.13, 205.27, 858, 848, DIG. 26, 206.12–206.14, 206.19, 206.21, 206.24, 206.25, 206.28, 207.11, 201.17; 606/199, 204.45

(56) References Cited

U.S. PATENT DOCUMENTS 4,646,731 A * 3/1987 Brower ..... 128/156
5,609,150 A * 3/1997 Maged ..... 128/201.18
5,803,075 A * 9/1998 Yavitz ..... 128/206.25
5,842,469 A * 12/1998 Rapp et al. ..... 128/200.24
5,842,470 A 12/1998 Ruben
5,931,854 A * 8/1999 Dillon ..... 606/204.45
6,006,746 A * 12/1999 Karell ..... 128/200.24
6,029,658 A * 2/2000 DeVoss ..... 128/200.24
6,058,931 A * 5/2000 Muchin ..... 128/200.24
6,065,470 A * 5/2000 Van Cromvoirt et al. ..... 128/200.24
6,116,236 A * 9/2000 Wyss ..... 128/200.24
6,228,101 B1 * 5/2001 Stratton ..... 606/199

* cited by examiner

*Primary Examiner*—John G. Weiss
*Assistant Examiner*—Teena Mitchell
(74) *Attorney, Agent, or Firm*—Paul J. Sutton; Barry G. Magidoff

(57) ABSTRACT

A surgical mask of the type worn about the nose and face and tied about the head or ears. To the inner surface of the mask, a nasal dilator, in the form of two attachment devices, each with a base upon which two layers of pressure sensitive adhesive is applied using one of the adhesive layers. The mask is pinched in towards the sides of the nose and the adjacent portions of the face to attach the mask to the nose and adjacent portions of the face. When the pinch in forces are removed the mask attempts to return to its initial position and outwardly moves the skin and muscles of the sides of the nose and adjacent face portions to expand the nasal passages of the nose. The attachment devices cover muscles which control the lower valve and the inner valve of the nose and are attached with ⅔ of their area on the nose and ⅓ of their area on the face.

20 Claims, 16 Drawing Sheets

SURGICAL MASK WITH NASAL DILATOR

BACKGROUND OF THE INVENTION

1. Field of the Invention

This invention is directed to surgical masks worn by surgeons, dentists and the like and which cover the nose, mouth, chin and portions of the cheeks and more particularly to such a mask that does not interfere with the breathing of the mask wearer.

2. Description of the Prior Art

A nasal dilator prevents the outer wall tissue of the nasal passages of the nose from drawing in during breathing and thus reduces the amount of air which can be taken in. One approach to counter the drawing in of the outer wall tissue is the use of a band, which includes a resilient member. The resilient member is initially flat and when applied to the wearer's nose is caused to take on an accurate configuration. The resilient member has an elastic memory and attempts to return to its initial flat condition forcing the outer wall tissue of the nose to move outwardly and open the nasal passages.

This approach has been applied to surgical masks so that the mask does not interfere with the breathing of the mask wearer. One device uses a base layer having a first face upon which a first layer of pressure sensitive adhesive is placed to adhere to the outer wall tissue of the nose. A second layer of pressure sensitive adhesive is placed upon the opposite face of the base layer to adhere to the interior surface of a surgical mask. A counterbalance strip is placed on a portion of the second layer of adhesive so that it is placed between the base layer and the mask. The counterbalance strip is a flat resilient strip of plastic or the like with an elastic memory so that when the mask is put on, the counterbalance strip is caused to take on an accurate shape about the nose. When the forces used to adhere the mask to the nose are removed, the counterbalance strip attempts to return to its initial position and pulls the outer wall tissue outwardly increasing the size of the nasal passageways and permitting easier breathing.

Present nasal dilators are positioned above the flared portion of the nose and extend from one side of the nose over the dorsum to the other side of the nose as shown in FIG. 6. In such a placement the nasal dilator operates over the lower or traverse nasalis muscles but does not effect procerus muscles or levator labii superioris alacque nasi muscles closer to the bridge of the nose and thus limits the amount the outer wall tissue can be moved and the size of the nasal passage.

SUMMARY OF THE INVENTION

The instant invention overcomes the difficulties noted above with respect to the prior art by eliminating the flexible resilient strip entirely and using the mask itself as the resilient member. Two layers of adhesive are used to attach the attachment means to the inner surface of the mask body and to the nose and face of the mask wearer. The attachment means is proportioned to extend from above the flared nostrils or ala towards the bridge of the nose to act upon the face and a number of muscles that control the nasal passageway. The two attachment means each have a base layer and a first adhesive layer on one face of the base layer for attachment to the inner surface of the mask body. A second adhesive layer is placed on the other face of the base layer to adhere to the nose and a portion of the face adjacent the nose. The base layer is so positioned that two thirds of the attachment means area is over the sides of the nose and one third of the area is over the face of the wearer adjacent the nose.

A surgical mask when placed over the nose and portions of the cheeks does not follow the contours of the nose and cheeks but rather forms a generally triangular shaped structure with the nose dorsum at the apex of the triangle and the mask body ends at the cheeks. Because the mask body is generally stiff and does not follow the contours of the nose and face, voids are created between the inner surface of the mask body and the sides of the nose and adjacent face portions. The attachment means are each located on the mask body adjacent one of these voids. The mask body is depressed towards the wearer's face and nose using forces applied to the mask body over the voids until the second adhesive layer of said base layer is firmly engaged with the wearer's nose and face at which time the depressing forces are removed and the mask body tries to return to its initial position and pulls the outer wall tissue of the nose and the adjacent face portion outwardly thereby increasing the size of the nasal opening. It is an object of the invention to provide a surgical mask with an improved nasal dilator.

It is an object of the invention to provide a surgical mask with an improved nasal dilator which dispenses with the need for a separate flexible resilient counterbalance strip.

It is yet another object of the invention to provide a surgical mask with an improved nasal dilator which employs the resilience of the surgical mask body to provide the forces required to outwardly displace the outer wall tissue of the nose and adjacent face portions.

It is still another object of the invention to provide a surgical mask with an improved nasal dilator that acts upon a greater portion of the outer tissue of the nose and adjacent face portions than previously known devices.

Other objects and features of the invention will be pointed out in the following description and claims and illustrated in the accompanying drawings, which disclose, by way of example, the principles of the invention, and the best modes which are presently contemplated for carrying them out.

BRIEF DESCRIPTION OF THE DRAWING

In the drawing in which similar elements are given similar reference characters.

DESCRIPTION OF THE PREFERRED EMBODIMENTS

Figure 1:
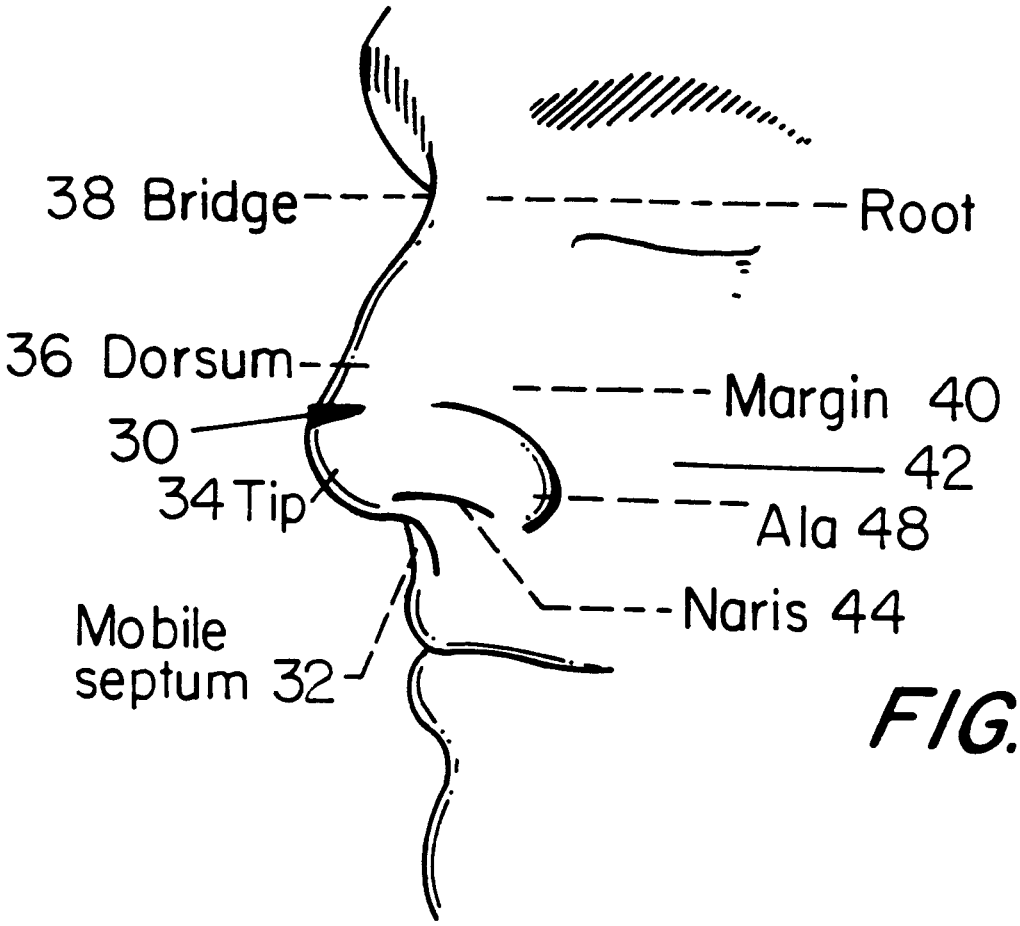
FIG. 1 is a side view of a face and nose.
Figure 2:
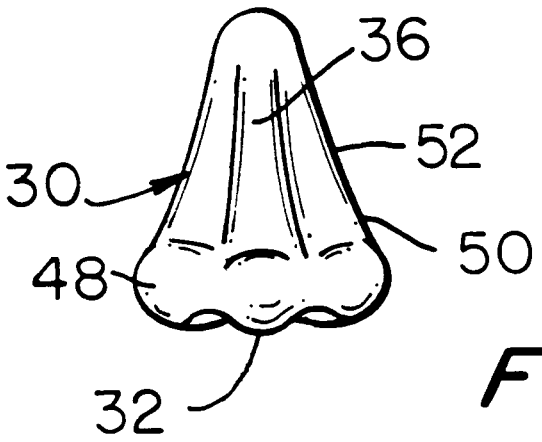
FIG. 2 is a front view of a nose.

Turning first to FIGS. 1 to 5 certain exterior and interior structures of the nose and adjacent facial portions are shown. The nose 30 extends from a mobile septum 32 over a tip 34 along dorsum 36 to bridge 38. The margin 40 marks the transition from the nose 30 outer wall tissue to the face 42. The nasal passages or naris 44 extend through the nose 30 from the lower portion of the ala 48 or outwardly flared nostrils. As will be explained below, the muscle groups adjacent the ala 48 provide a lower valve 50 for the nasal passages to open or constrict such nasal passages. The muscle groups between the ala 48 and the bridge 38 provide an inner valve 52 for the nasal passages to also open or constrict such nasal passages.

Figure 3:
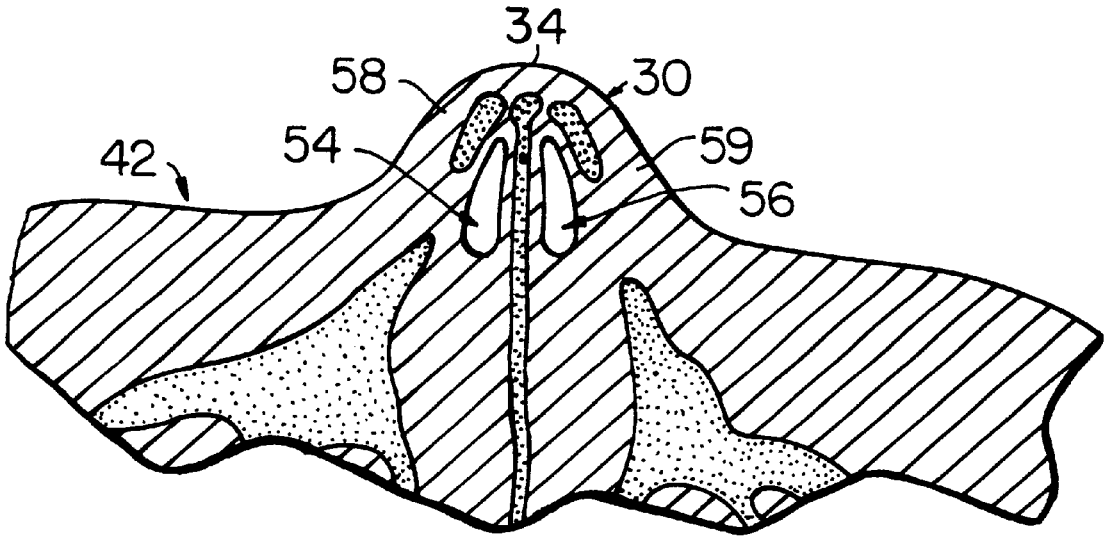
FIG. 3 is a top sectional view of a nose and adjacent face portions showing fully open nasal passages.
Figure 4:
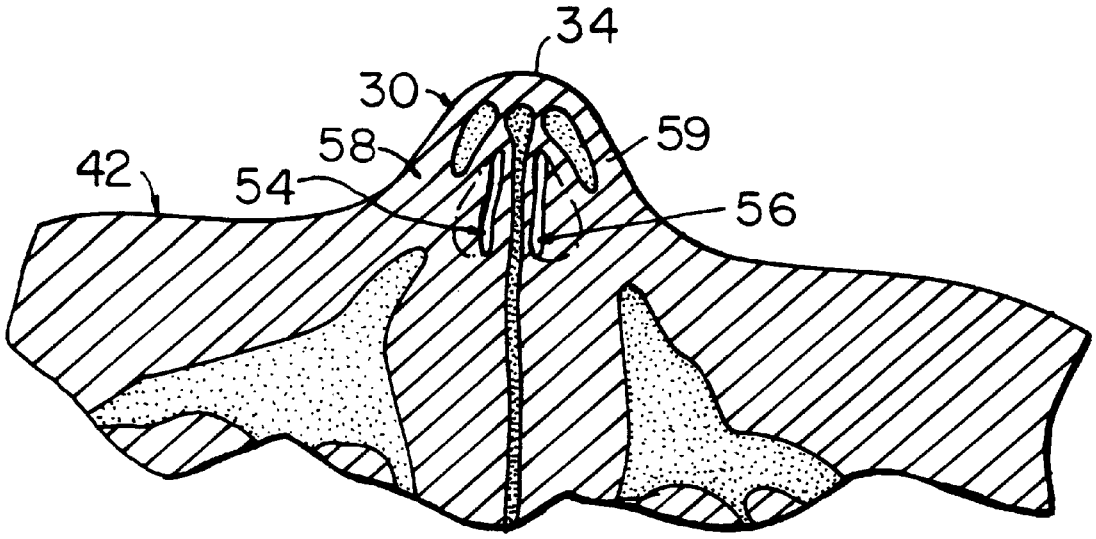
FIG. 4 is similar to FIG. 3 but with the nasal passages constricted.

FIG. 3 shows a healthy nose with the nasal passages 54 and 56 open to their maximum extent and outer wall tissue 58, 59 at its minimum size. The presence of a malfunction, such as a deviated septum, or swelling due to allergic reactions, causes the outer wall tissue 58, 59 to be drawn in or collapse and restrict or completely block the nasal passages 54, 56 respectively as is shown in FIG. 4.

Figure 5:
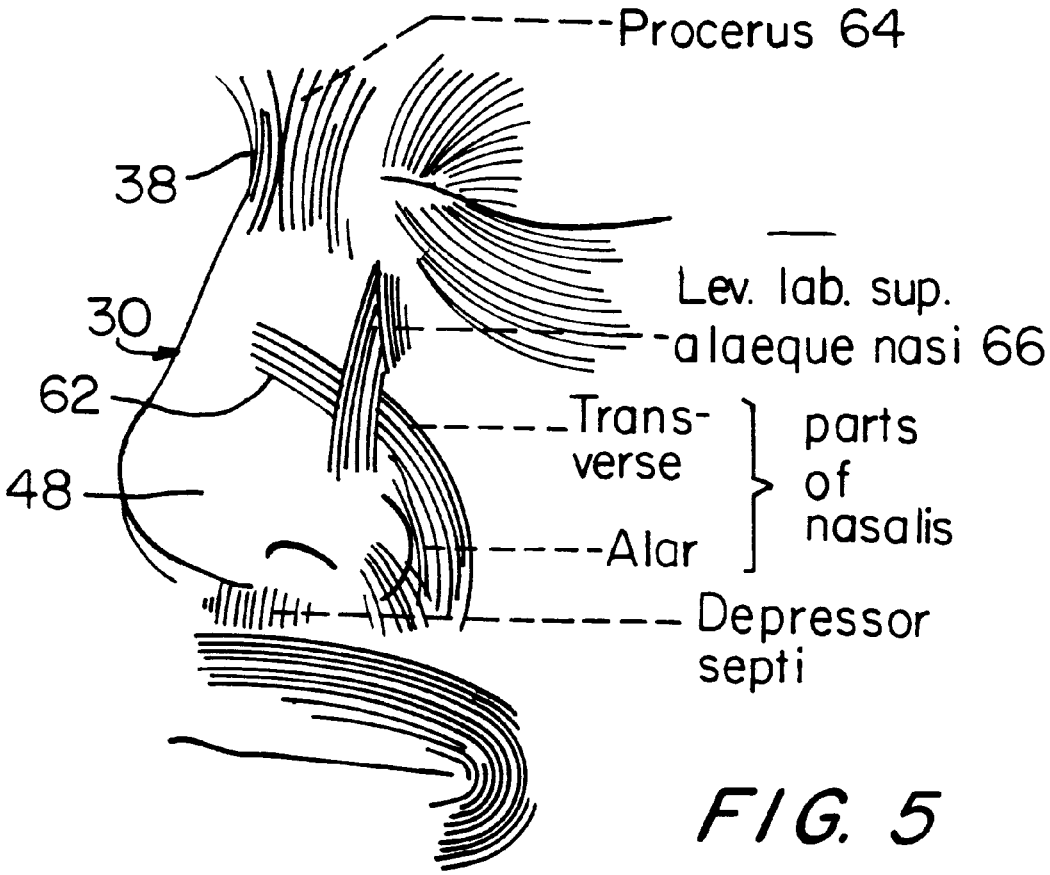
FIG. 5 is an illustration of a nose and adjacent face portions showing the various muscle groups therein.

FIG. 5 shows the major muscle groups of the nose 30 and adjacent portion of the face 42. The transverse nasalis 62 extends over the top of the ala 48 and provides the lower valve 50. The procerus 64 and the levator labii superioris alacque nasi 66 extend over the top of the nose 30 in the region of bridge 38 and to the face portion 42 adjacent the nose 30. These muscle groups 64 and 66 operate the inner valve 52.

Figure 6:
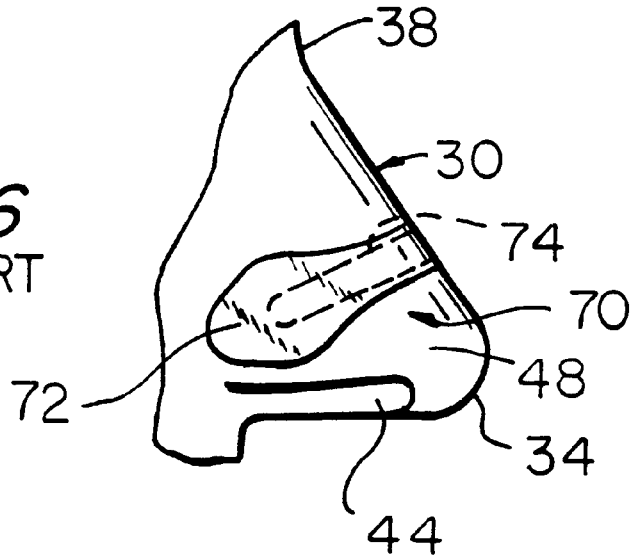
FIG. 6 PRIOR ART
FIG. 6 is an illustration of a nose with a prior art nasal dilator applied thereto and is FIG. 3 of U.S. Pat. No. 5,546,929 issued Aug. 20, 1996.

As shown in FIG. 6, a known prior art nasal dilator 70 is made up of an adhesive layer 72 to adhere to the nose 30 of a wearer and a flexible, resilient strip 74. The nasal dilator 70 is positioned above the ala 48 and over the transverse nasalis 68. The nasal dilator 70 also extends across the dorsum 36 and above the ala 48 on the opposite side of the nose 30 but not visible in the figure. The strip 74 is flat before installation upon the nose 30 and is formed into a generally U-shape by such installation. The strip 74 has a plastic memory and attempts to return to its initial, flat state, thus providing the opening forces to open the lower valve 50 of the nasal passages or naris 44 by acting upon the muscle group 62. The nasal dilator 70 has no effect on the large muscle groups 64 and 66 and thus fails to assist in opening the inner valve 52.

Figure 7:
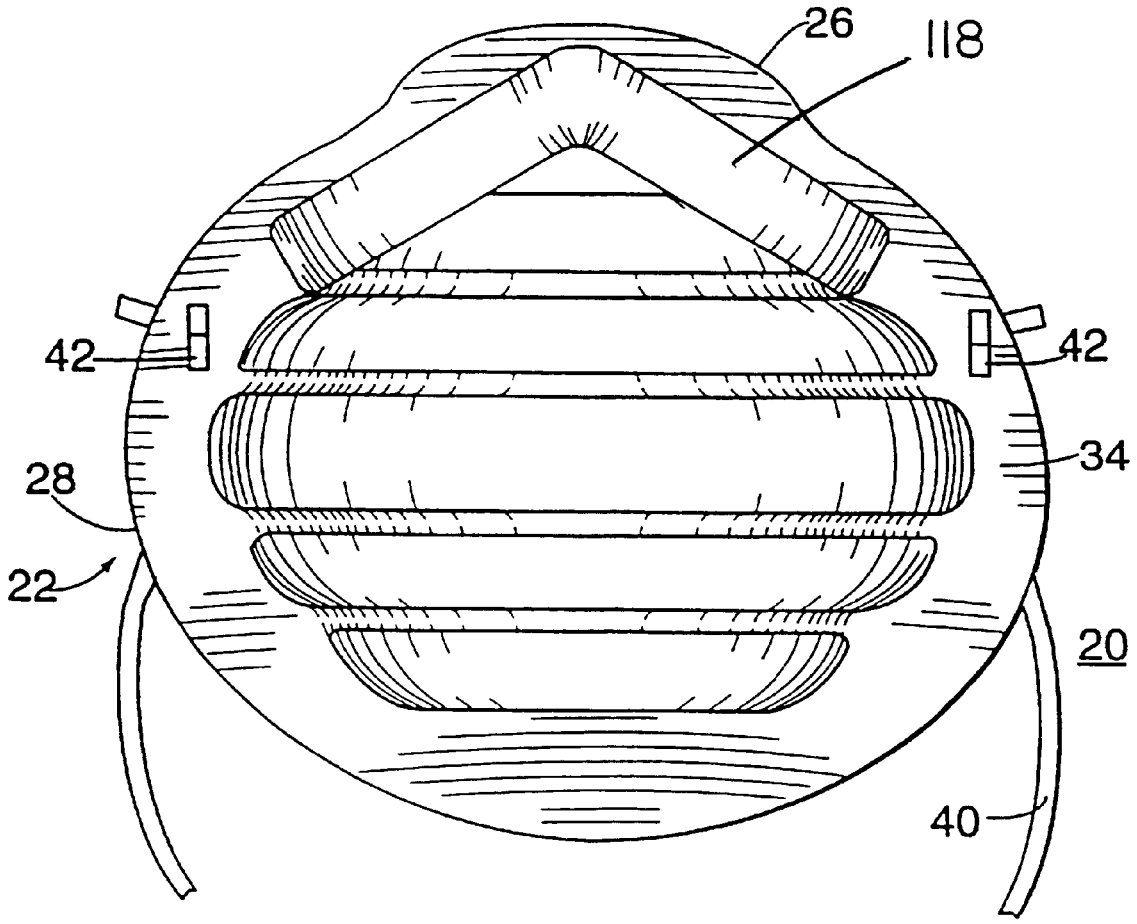
FIG. 7 PRIOR ART
FIG. 7 shows a rear elevational view of prior art surgical mask with a nasal dilator and is FIG. 8 of U.S. Pat. No. 5,842,470 issued Dec. 1, 1998.
Figure 8:
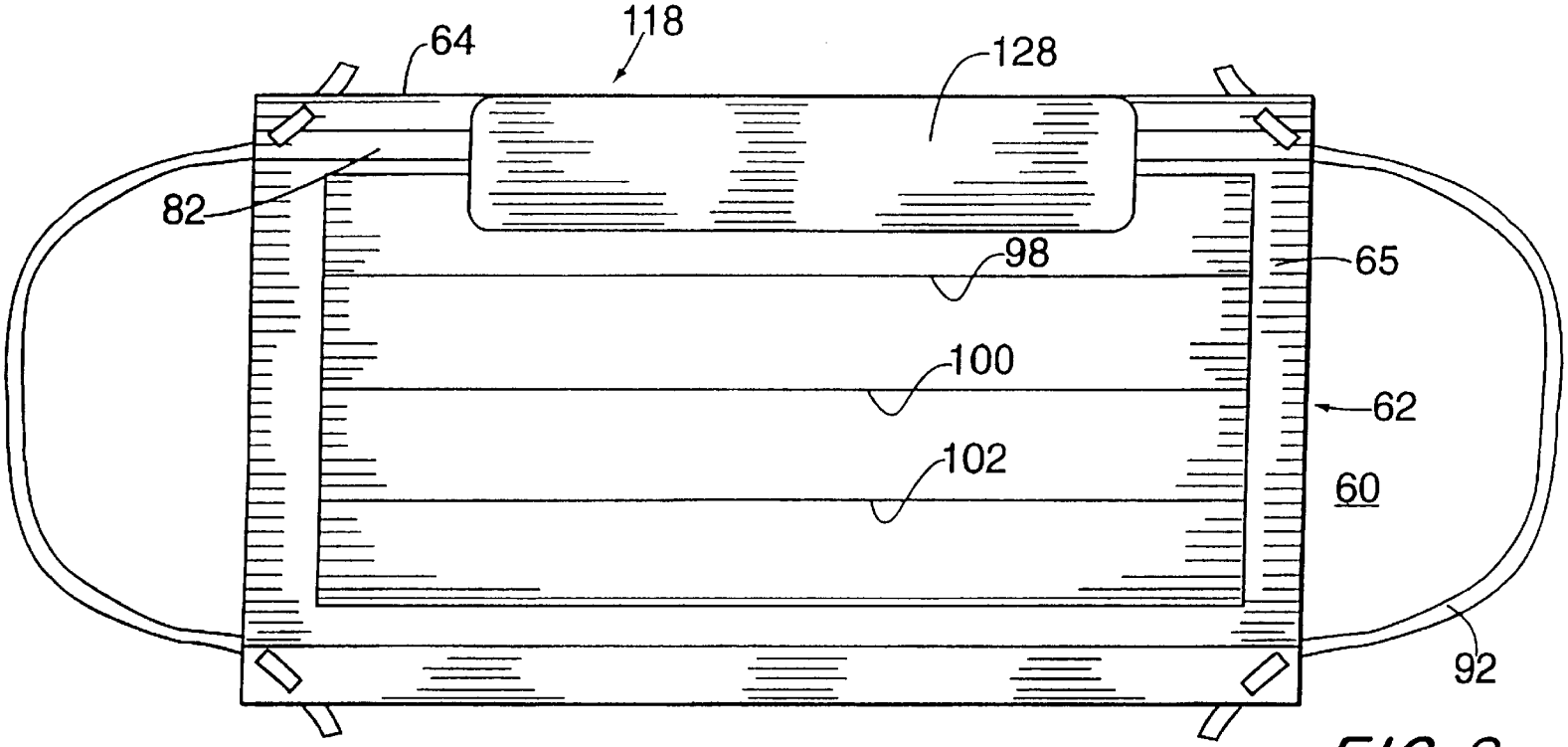
FIG. 8 PRIOR ART
FIG. 8 shows a rear elevational view of another prior art surgical mask with a nasal dilator and is FIG. 13 of the '470 patent.
Figure 9:
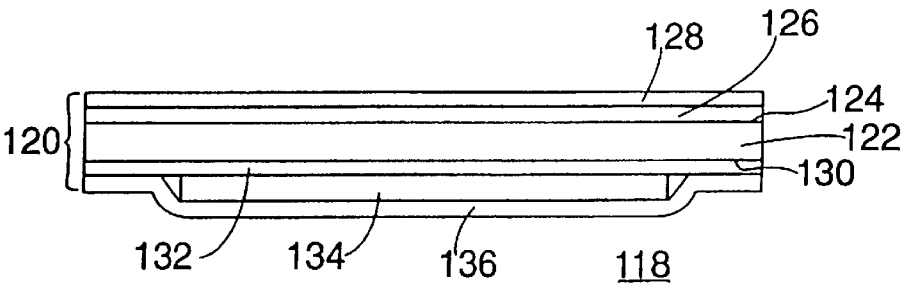
FIG. 9 PRIOR ART
FIG. 9 is a top plan view of the nasal dilator of the '470 patent and is FIG. 9 thereof.
Figure 13:
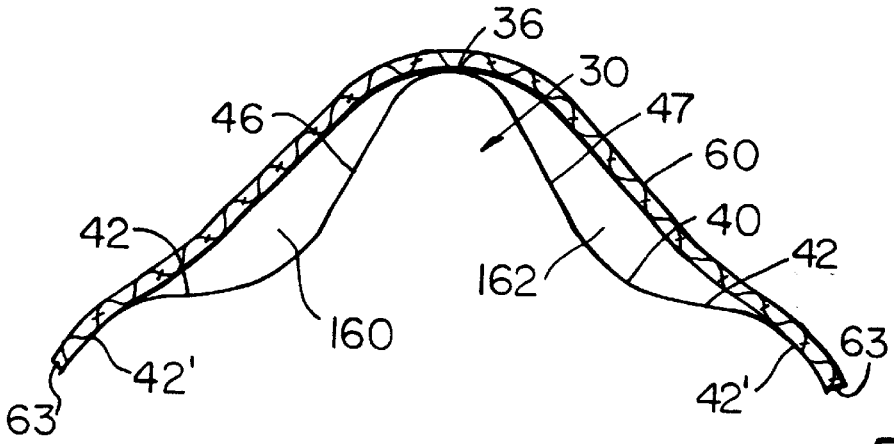
FIG. 13 PRIOR ART
FIG. 13 is top plan view, partly in section, of a nose and adjacent facial portions and showing the normal position of a surgical mask according to the prior art thereon.

FIGS. 7, 8 and 9 show surgical masks employing a nasal dilator according to the prior art and are respectively, FIGS. 8, 13 and 9 of U.S. Pat. No. 5,842,470. These masks 20 (FIG. 7) and 60 (FIG. 8) use a nasal dilator or easier breathing device 118 as shown in FIG. 9. The easier breathing device 118 consists of layer of pressure sensitive adhesive 126 protected by a release layer 128 which is removed to adhere the masks 20 and 60 to the nose of the wearer. A base layer 122 has a first surface 124 to which the pressure sensitive adhesive layer 126 is applied and a second surface 130 to which another layer of pressure sensitive adhesive 132 is applied. The central portion of the adhesive layer 132 is covered by a counterbalance strip 134. A release layer 136 covers the strip 134 and the remaining exposed portions of the adhesive layer 132. Release layer 136 is removed to permit the easier breathing device 118 to be adhered to the inner surface of the masks 20 and 60. The easier breathing device 118 extends over the dorsum and is adhered to the nose 30 above the ala 48 and operates, as described above, on the lower valve 50 of FIG. 2.

Figure 10:
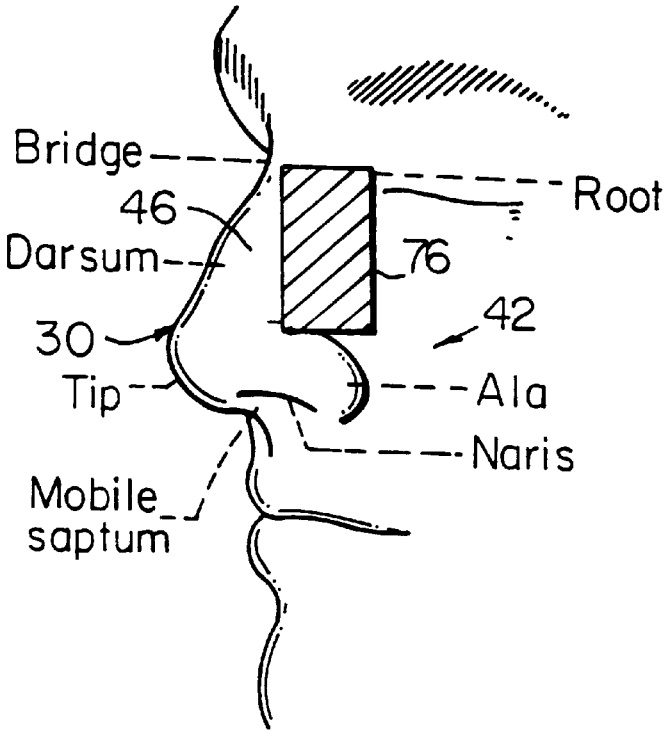
FIG. 10 is the nose of FIG. 1 with a first form of nasal dilator attachment means applied thereto and with the mask body omitted.
Figure 11:
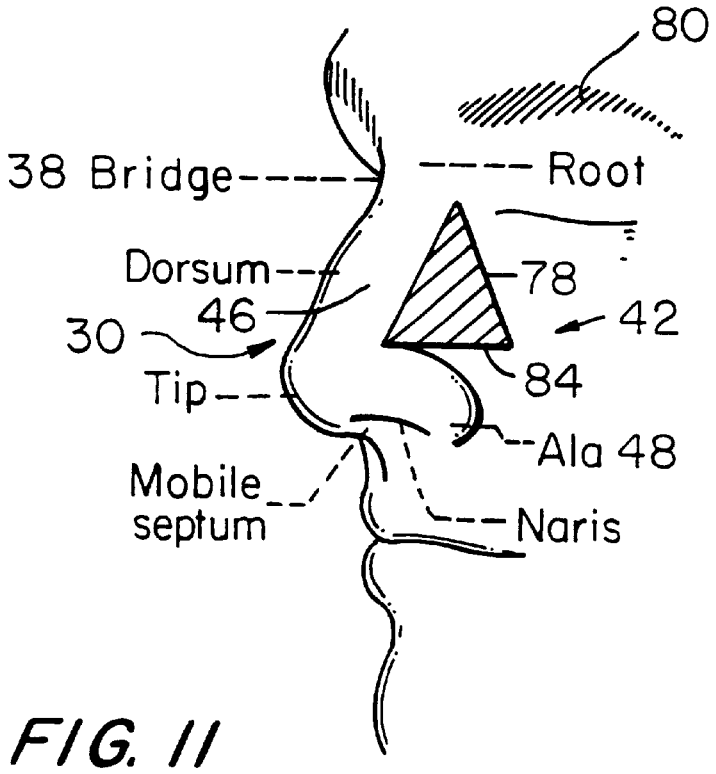
FIG. 11 is the nose of FIG. 1 with a second form of nasal dilator attachment means applied thereto and with the mask body omitted.
Figure 12:
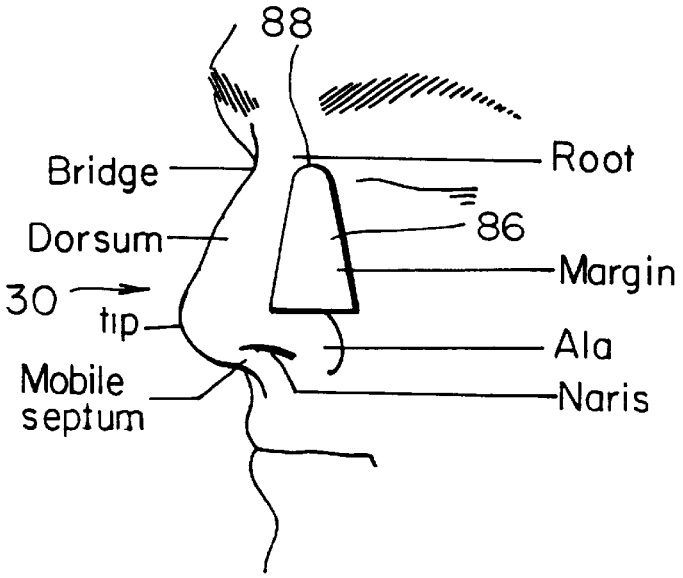
FIG. 12 is the nose of FIG. 1 with a third form of nasal dilator attachment means applied thereto and with the mask body omitted.

It has been found that it is possible to provide increased dilation by using a nasal dilator which operates upon the lower valve 50 and the inner valve 52. The nasal dilator is made up of two attachment means one for each side 46, 47 of nose 30 and adhered to a surgical mask inner surface and to the nose 30 and adjacent face portions 42. The attachment means are each proportioned such that two thirds of the attachment means area is adhered to the side 46, 47 of a nose 30 and one third of the attachment means area is adhered to the side of the face 42 and over the margin 40. The attachment means can take many different shapes, each of which is proportioned in size to maintain the 2/3:1/3 ratio. FIG. 10 shows one of the rectangular attachment means 76 which are rectangular in shape and attached to the side 46 of the nose 30 and to the face 42 and extend over the margin 40. FIG. 11 shows a triangular shaped attachment means 78 whose apex 80 is adjacent the bridge 38 of nose 30 and whose base 84 is adjacent the top of ala 48. In FIG. 12 a modified triangular attachment means 86 is shown. The apex 80 has been rounded as at 88 to provide greater comfort to the wearer.

Figure 27:
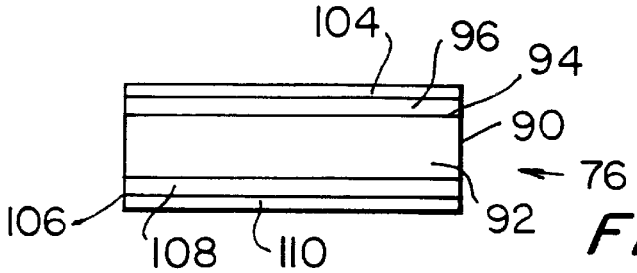
FIG. 27 is a front elevational view of an attachment means according to the instant invention.

Each of the attachment means 76, 78 and 86, as well as other attachment means to be described below are composed of a number of layers as shown in FIG. 27. A base layer 90 is made up of foam or any other material, which is compliant but solid. Base layer 90 has a first face 94 to which is applied a first layer of pressure sensitive adhesive 96 protected by a first release layer 104 and a second face 106 to which is applied a second layer of pressure sensitive adhesive 108 protected by a second release layer 110. One of the release layers 110, 106 is removed to expose one of the associated adhesive layers 96, 108, respectively and the attachment means 76, 78 or 86 is adhered to the inner surface of a mask as will be described below. One attachment means 76, 78 or 86 is positioned on the mask so that it can be brought into contact with one side 46 of a nose 30 and the adjacent portion of the face 42. The second attachment means 76, 78 or 86 is then positioned so that it can make contact with the second side 47 of the nose 30 and the adjacent portion of the face 42.

Figure 17:
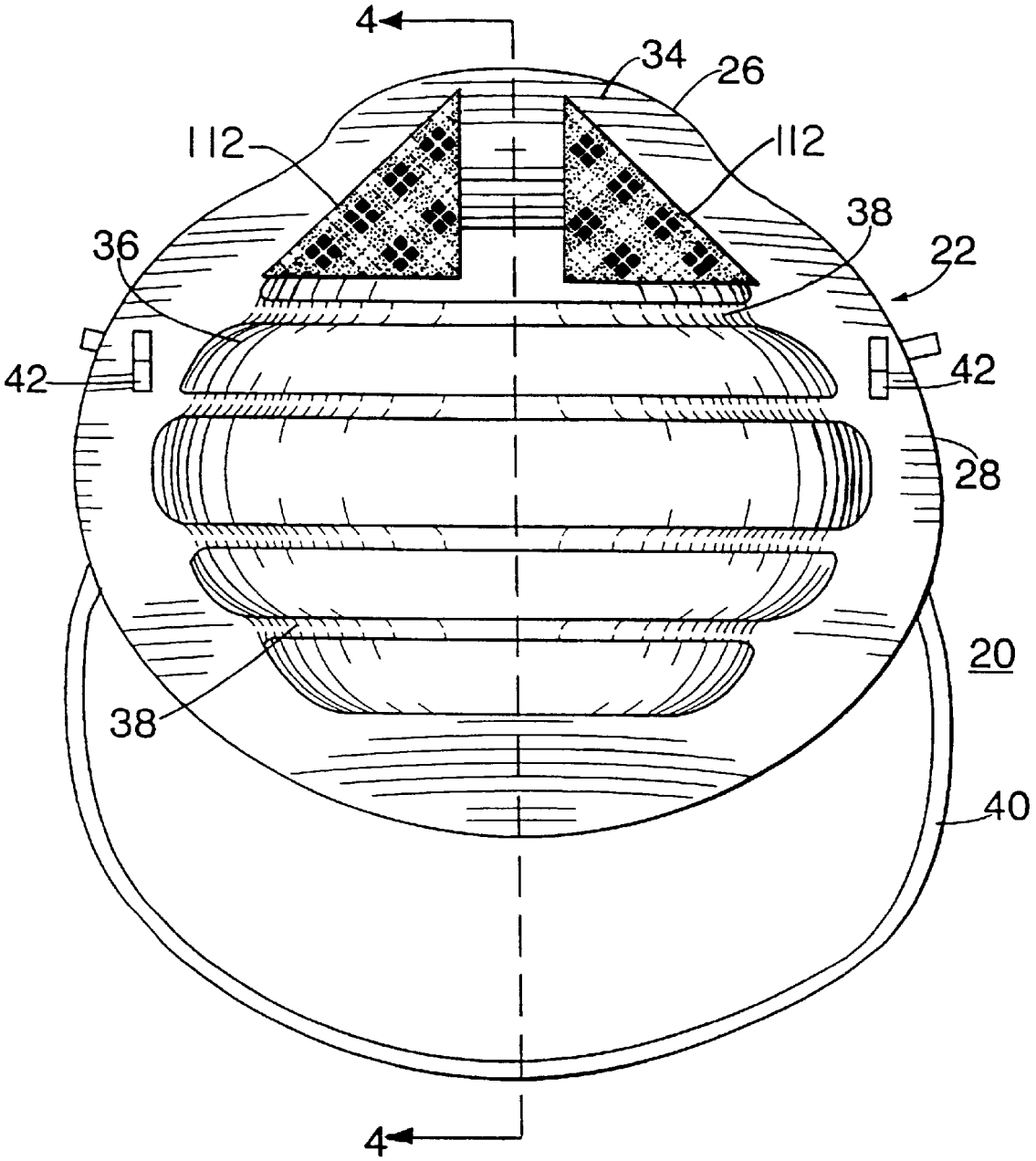
FIG. 17 is a rear elevational view of a cone-type facial surgical mask with a fourth form of a nasal dilator attachment means applied thereto.
Figure 18:
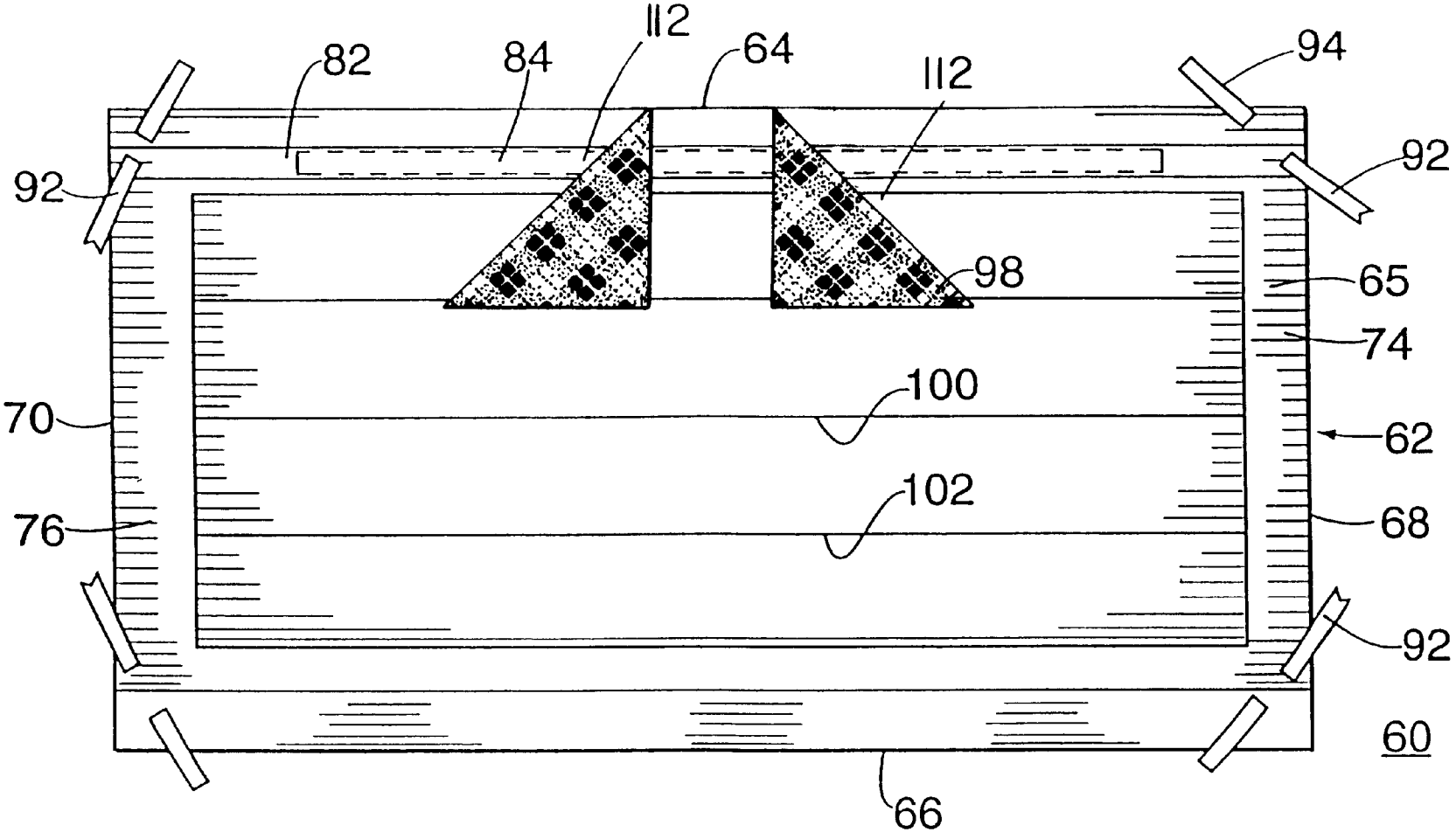
FIG. 18 is a rear elevation view of a rectangular-type facial surgical mask with the nasal dilator attachment means of FIG. 17 applied thereto.
Figure 19:
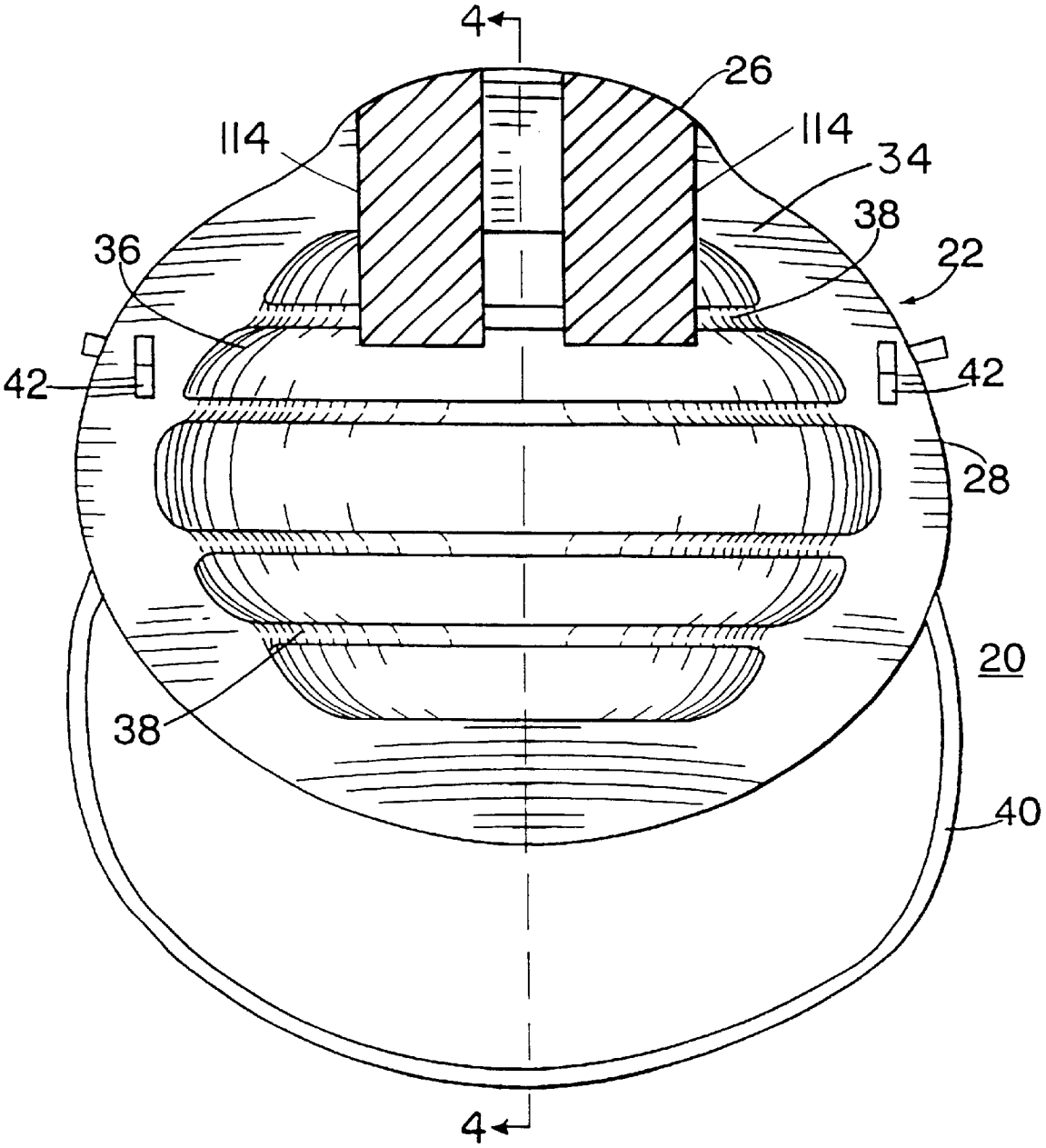
FIG. 19 is a rear elevational view of the facial surgical mask of FIG. 17 with a fifth form of nasal dilator attachment means applied thereto.
Figure 20:
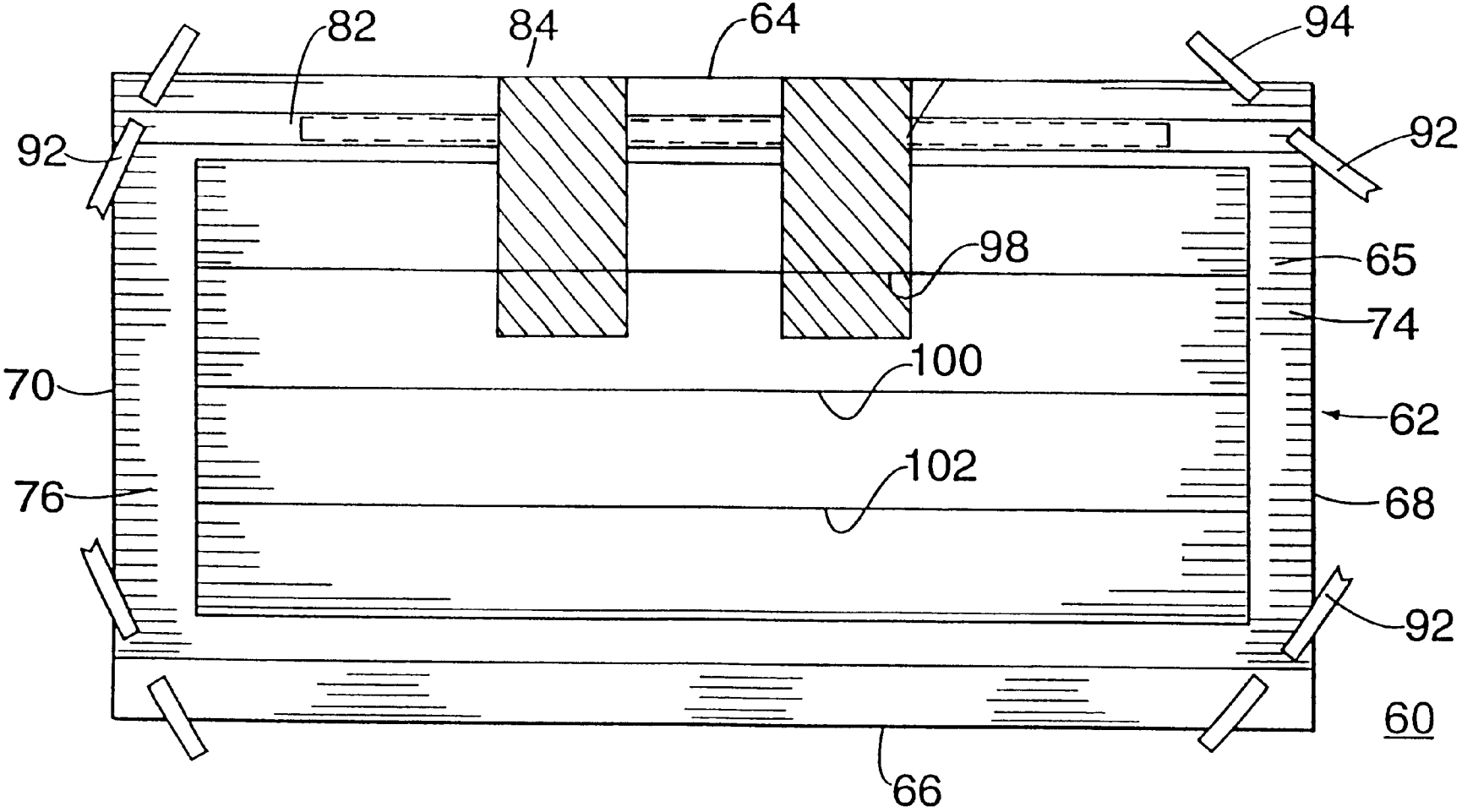
FIG. 20 is a rear elevational view of the facial surgical mask of FIG. 18 with the fifth form of nasal dilator attachment means of FIG. 19 applied thereto.
Figure 21:
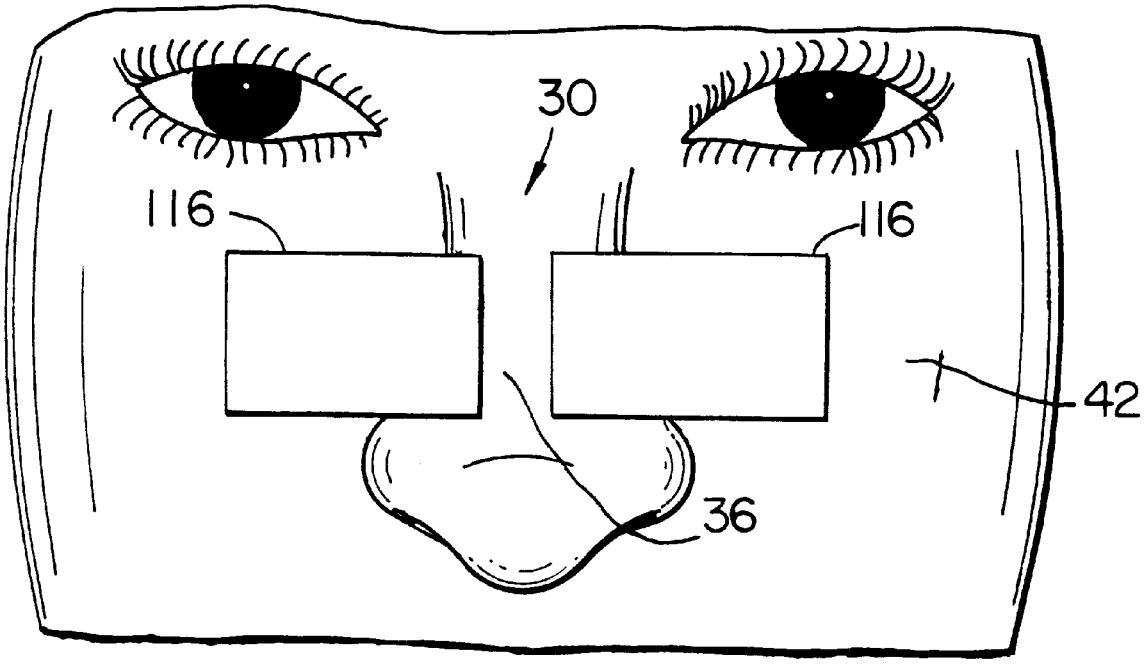
FIG. 21 is an illustration of a face with a sixth form of nasal dilator attachment means applied thereto and omitting the mask body.
Figure 22:
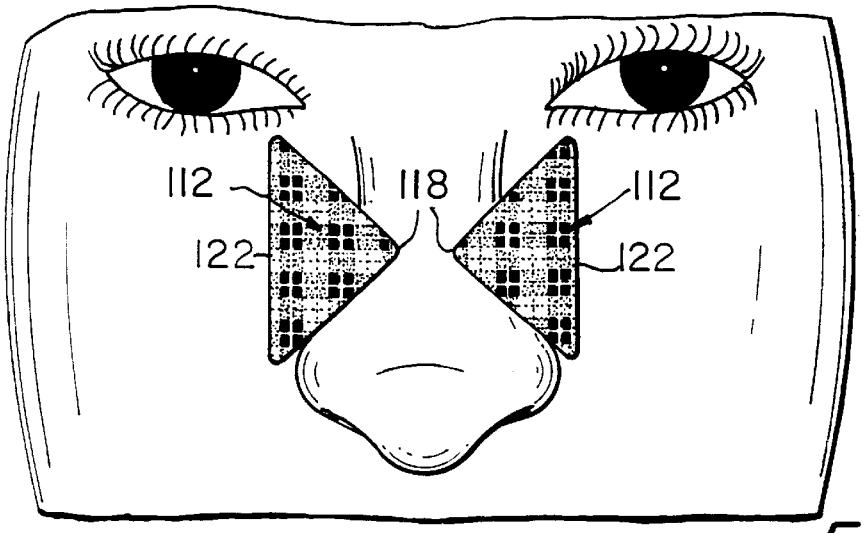
FIG. 22 is an illustration of a face with a seventh form of nasal dilator attachment means applied thereto and omitting the mask body.
Figure 23:
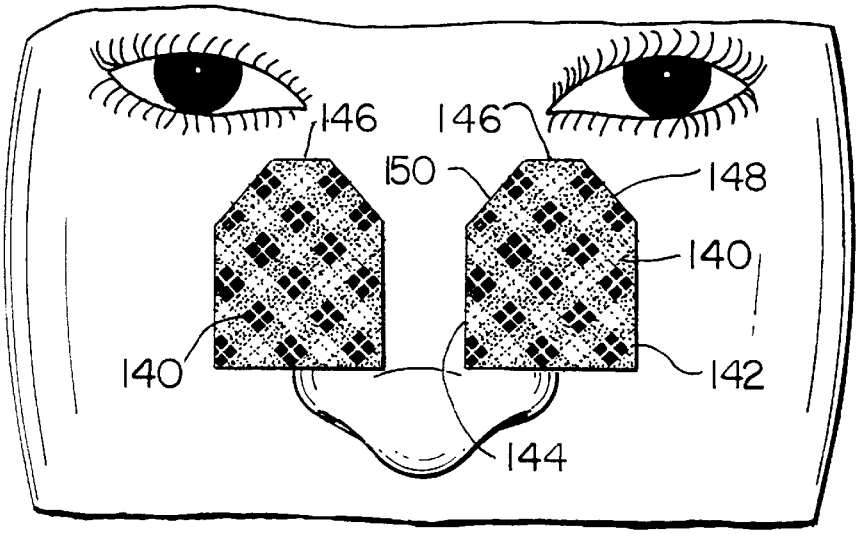
FIG. 23 is an illustration of a face with an eighth form of nasal dilator attachment means applied thereto and omitting the mask body.
Figure 24:
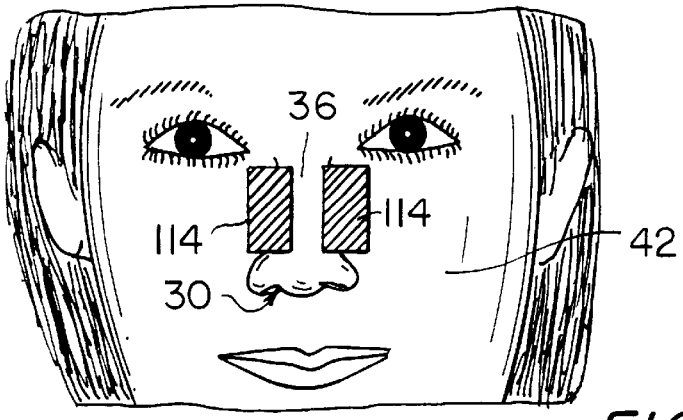
FIG. 24 is an illustration of a face showing the positions of the attachment means of FIG. 19 thereon with the mask body omitted.
Figure 28:
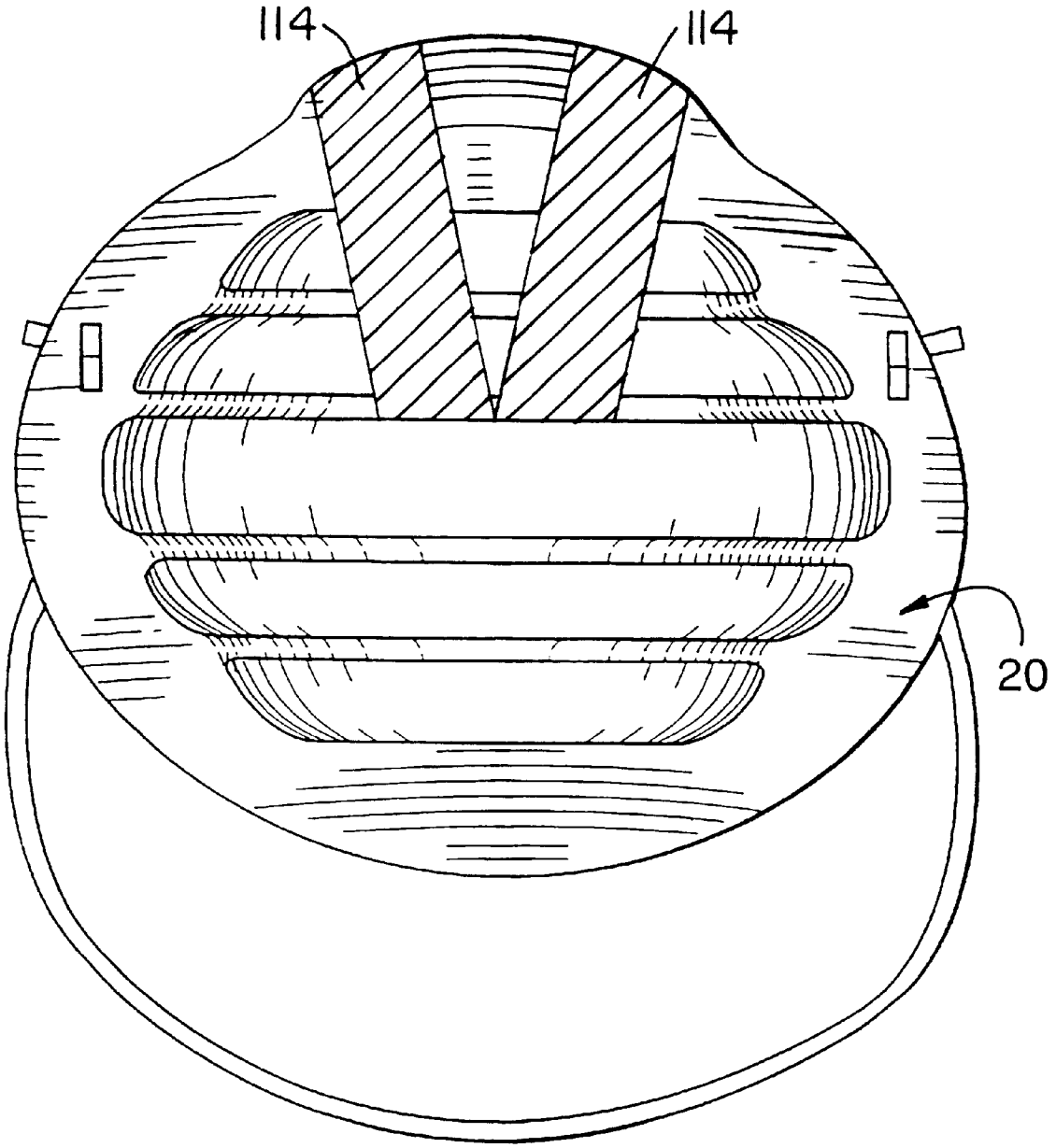
FIG. 28 is a rear elevational view of a prior art cone-type mask with a ninth form of nasal dilation attachment means applied to the inner surface of such mask
Figure 29:
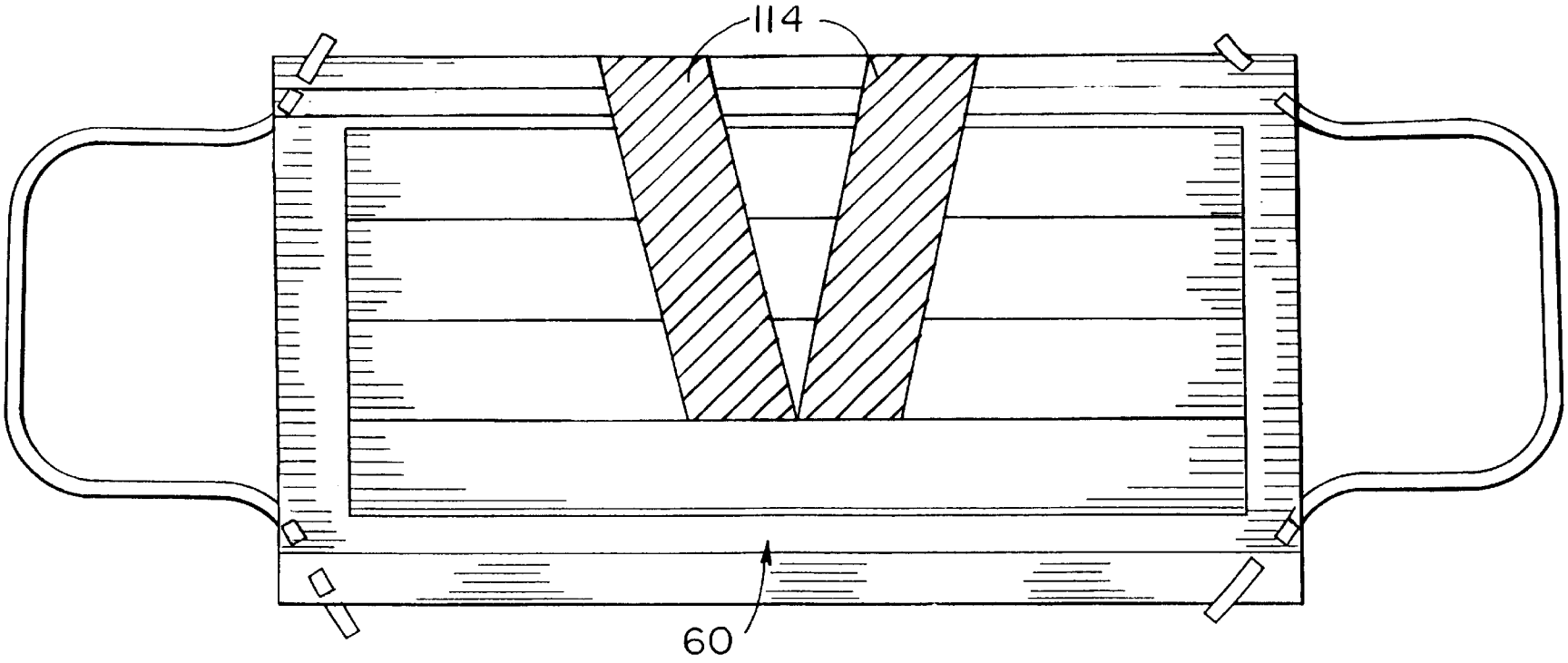
FIG. 29 is a rear elevational view of a rectangular-type facial surgical mask with the ninth form attachment means applied to the inner surface of such mask.

Referring to FIG. 17 two triangular shaped attachment means 112 are attached to the inside surface 34 of mask 20 and in FIG. 18 the same two triangular shaped attachment means 112 are attached to the inside surface 65 of mask 60. The positioning of the attachment means 112 will be in conformance with the nose/face proportions as set forth above. FIGS. 19 and 20 show the positioning of two generally rectangular attachment means 114 on the inside surface 34 of mask 20 and inside surface 65 of mask 60. The position of the attachment means 114 with respect to the face of the wearer is shown in FIG. 24. The long dimension of a rectangular attachment means does not have to extend in parallel with the dorsum 36 of nose 30 but may extend at right angles thereto as shown in FIG. 21 where each of the attachment means 116 extend from the dorsum 36 onto the face 42. The rectangular attachment means 114 may also be set on a diagonal to the mask 20 as shown in FIG. 28 or the mask 60 shown in FIG. 29. Some trimming of the ends of the attachment means 114 may be necessary to conform to the shape of the respective masks 20, 60. Similarly, the triangular attachment mean 112 can be rotated 90° so that apex 118 extends to the dorsum 36 and the base 122 is parallel with the dorsum 36 as shown in FIG. 22. A modified rectangular attachment means 140 is shown in FIG. 23. The attachment means 140 is generally rectangular but has portions of the side edges 142, 144 and the top edge 146 removed as at 148, 150 to prevent contact with the eyes of the wearer. FIGS. 22, 23 and 24 show the various attachment means 112, 140 and 114 in their position on the face of the wearer with no mask present to appreciate the interaction of the attachment means with the nose and face of the wearer.

Figure 25:
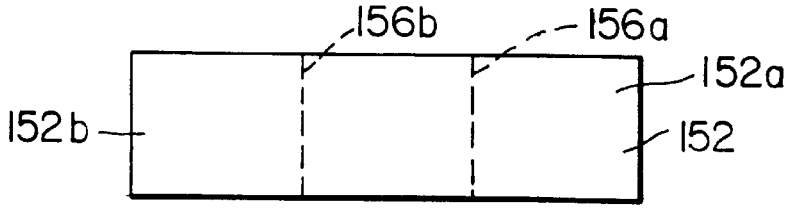
FIG. 25 is a top plan view of two attachment means covered with a single release material.
Figure 26:
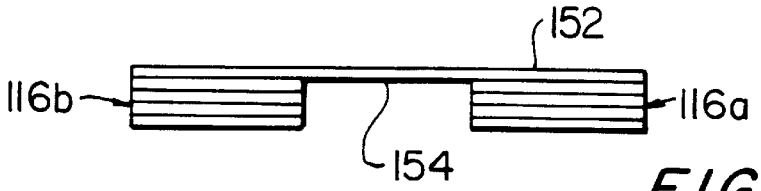
FIG. 26 is a side elevational view of the device of FIG. 24.

Although the attachment means are generally made of separate pads the two attachment means can be covered with a common release layer 152 of a non-woven material, such as felt, which adheres to the adhesive layer 108 and bridges as at 154 the two attachment means 116 as shown in FIGS. 25 and 26. The release layer 152 is scored as at 156 to permit portions of the release layer 152 to be removed without affecting the attachment means 116 which is covered by the release layer 152. If the wearer does not wish to use the nasal dilator at all, he can retain the release layer 152 in place providing a cushion over the dorsum 36 of nose 30. If only one side of the nose, for example side 46, is to be engaged by an attachment means 116*b*, the release layer 152 is torn at score lines 156*a* and 156*b* to separate attachment mean pads 116*a* and 116*b* and to remove the bridge 154. The release layer 152*b* of attachment means 116*b* can be removed and the adhesive layer thereunder used to adhere the mask to the nose and face. The release layer 152*a* can be retained on attachment means 116*a* to prevent adherence to the side 47 of nose 30.

Turning now to FIGS. 13 to 16, the operation of the instant invention is shown and described. A mask such as 60 when positioned on a wearer extends across the dorsum 36 as the high point and the mask 60 ends 63 engage the cheeks of such wearer. The mask 60 is held in place by anyone of a number of fastening means, namely strings that tie behind the head, strings that go about the ears or the like. The fastening means are intended to place the overall mask 60 in tension. In FIG. 13, the position of the mask 60 with respect to the dorsum 36 of nose 30 and the ends 63 of the mask 60 is shown. Mask 60 follows the dorsum 36 which spaces the mask 60 from the face 42. The ends 63 of the mask 60 engage the face 42. With the mask 60 stretched by the fastening means about the head or ears and the dorsum 36 of nose 30 space 160 exists between the side 46 of nose 30 and the face portion 42. In a similar fashion, space 162 exists between the side 47 of nose 30 and the face portion 42.

Figure 14:
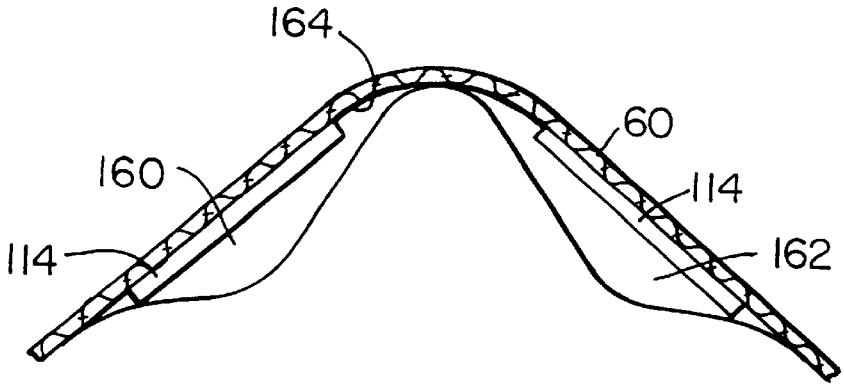
FIG. 14 is a plan view, partly in section, of a nose and adjacent facial portions, as shown in FIG. 13 but with two attachments means, according to the concepts of the invention, mounted on the inner surface of the surgical mask.

FIG. 14 shows the mask 60 of FIG. 13 but with attachment means, such as attachment means 114 adhered to the inside surface 164 of mask 60 and each of the two attachment means 114 is located in one of the spaces 160, 162 respectively. It should be noted that the attachment means 114 are not in contact with the nose 30 or the face 42.

Figure 15:
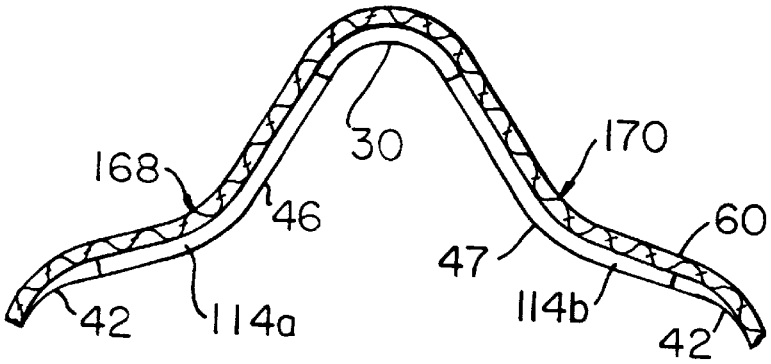
FIG. 15 is a plan view, partly in section, of a nose and adjacent facial portions as shown in FIG. 13 with the surgical mask depressed towards the nose and facial portions to install the two attachment means to the nose and face of the mask wearer.

To engage the attachment means 114 with the nose 30 and face 42 it is necessary to pinch in the mask 60 as shown in FIG. 15. The mask 60 has an inwardly directed force along arrow 168 applied by the thumb of the wearer and a second inwardly directed force applied along arrow 170 by the forefinger of the wearer. As a result the attachment means 114*a* is attached to the side 46 of nose 30 and to the adjacent portion of the face 42 and attachment means 114*b* is attached to the side 47 of nose 30 and to the adjacent portion of the face 42.

Figure 16:
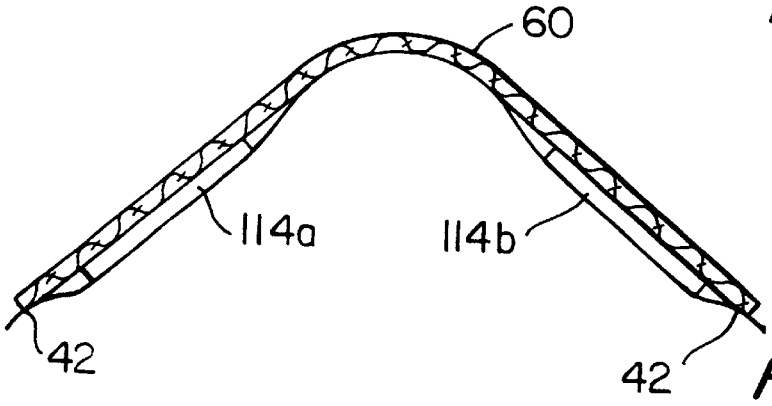
FIG. 16 is a plan view, partly in section, of the nose and adjacent facial portions expanded by the recovering surgical mask.

When the pinching forces along arrows 168 and 170 are removed, the mask 60 attempts to return to its initial position as shown in FIG. 13. As it does it lifts the skin of the nose 30 on sides 46 and 47 and the adjacent skin of the face 42 as shown in FIG. 16 along with the muscles below the skin to open the nasal passages (not shown).

While there have been shown and described and pointed out the fundamental novel features of the invention as applied to the preferred embodiments, as are presently contemplated for carrying them out, it will be understood that various omissions and substitutions and changes of the form and details of the devices illustrated and in their operation may be made by those skilled in the art, without departing from the spirit of the invention.

I claim:

1. A facial surgical mask comprising:

a) a mask body means composed of a resilient material and having an inner surface, an outer surface and a free peripheral edge thereabout, said mask body means proportional to fit over a nose, a mouth, a chin and portions of cheeks of a wearer;

b) fastening means coupled to said mask body means for holding said mask body means in the desired position over a nose, a mouth, a chin and portions of cheeks of a wearer after said mask body means has been placed in such desired position;

c) two attachment means, each having a first surface and a second surface;

d) a first adhesive layer on said second surface of each of said two attachment means to couple said second surfaces of said two attachment means to said inner surface of said mask body means so positioned as to overlie a portion of a nose and cheeks of a wearer with the two attachment means and the portion of a nose of a wearer in a non-dilating position; and e) a second adhesive layer on said first surface of each of said two attachment means to attach each of said two attachment means to a portion of a nose and cheeks of a wearer;

wherein after attachment of the mask body means by the second adhesive layers to the two attachment means, the resilience of the resilient material of the mask body means causes the two attachment means and a portion of a nose of a wearer to be oriented in a nasal dilating position.

2. A mask, as defined in claim 1, wherein said first adhesive layers of said two attachment means are covered with a plastic layer and said second adhesive layers of said two attachment means are covered with a non-woven material layer.

3. A mask, as defined in claim 2, wherein said non-woven material layer also extends between said two attachment means.

4. A facial surgical mask, comprising:

a) a mask body means having an inner surface, an outer surface and a free peripheral edge thereabout, said mask body means proportional to fit over a nose, a mouth, a chin and portions of cheeks of a wearer;

b) fastening means coupled to said mask body means for holding said mask body means in the desired position over a nose, a mouth, a chin and portions of cheeks of a wearer after said mask body means has been placed in such desired position;

c) two attachment means so configured to facilitate nasal dilation/breathing, said two attachment means each having a first surface and a second surface;

d) a first adhesive layer on said second surface of each of said two attachment means to couple said second surfaces of said two attachment means to said inner surface of said mask body means so positioned as to overlie a portion of a nose and cheeks of a wearer; and e) a second adhesive layer on said first surface of each of said two attachment means to attach each of said two attachment means to a portion of a nose and cheeks of a wearer;

wherein said first adhesive layers of said two attachment means are covered with a plastic layer and said second adhesive layers of said two attachment means are covered with a non-woven material layer; and wherein said non-woven material layer extends between said two attachment means and is scored at an inner edge of each of said two attachment means, with the inner edge positioned between the two attachment means, whereby the non-woven material layer may be selectively removed from one or both of the two attachment means.

5. A mask, as defined in claim 4, wherein each of said first and second adhesive layers are pressure-sensitive adhesives.

6. A mask, as defined in claim 5, wherein said first and second adhesive layers are each covered with a removable release layer.

7. A mask, as defined in claim 6, wherein said release layer is a removable plastic layer.

8. A mask, as defined in claim 4, wherein said mask can be applied to a nose and a cheek of a wearer using only one of said two attachment means.

9. A mask, as defined in claim 4, wherein each of said two attachment means has at least a first edge, a second edge and a base edge, said first edge, said second edge and said base edge together define an area of each of said two attachment means and each of said two attachment means are positioned with respect to a wearer such that two thirds of said attachment means area is in contact with a side of a nose of a wearer and one third of said attachment means area is in contact with a side of a face of a wearer adjacent a nose of a wearer.

10. A mask, as defined in claim 9, wherein each of said base edges of said attachment means is placed adjacent a flared nostril portion of a nose of a wearer and said inner edges of each of said attachment means extend towards a bridge of a nose of a wearer.

11. A mask, as defined in claim 9, wherein each of the two attachment means has the shape of a triangle; and wherein said first edge, said second edge and said base edge are the edges of the triangle with said base edge of each of said two attachment means is positioned adjacent a flared nostril portion of a nose of a wearer and a tip remote from said base edge of said attachment means formed by the juncture of said first and second edges of said attachment means extends towards a bridge of a nose of a wearer.

12. A mask, as defined in claim 9, wherein each of the two attachment means has the shape of a right triangle; and wherein said first edge, said second edge and said base edge are the edges of the right triangle with said first edge of each of said two attachment means, when placed on a nose of a wearer, extending towards a bridge of a nose of a wearer, said second edge extending in a direction perpendicular to said first edge and a base edge coupled between free edges of said first and second edges.

13. A mask, as defined in claim 9, wherein each of the two attachment means has the shape of a right triangle; and wherein said first edge, said second edge and said base edge are the edges of the right triangle with the base edge of each of said two attachment means extending along a face of a wearer of the mask from a flared nostril of a nose of a wearer toward a bridge of a nose and said first and second edges each extending from one end of said base edge and meeting in a point at the free ends of said first and second edges, said point extending along an outside of a nose of a wearer toward a dorsum.

14. A mask, as defined in claim 4, wherein each of said two attachment means have a first side and a parallel spaced apart second side, a first end and a parallel spaced second end, said first side, said second side, said first end and said second end together define an area of each of said two attachment means and each of said two attachment means are positioned with respect to a wearer such that two thirds of said attachment means area is in contact with a side of a nose of a wearer and one third of said attachment means area is in contact with a side of a face of a wearer adjacent a nose of a wearer.

15. A mask, as defined in claim 14, wherein each of the two attachment means has the shape of a rectangle; and wherein said first and second sides, and said first end and said second end are the sides of the rectangle with said second end of each of said two attachment means positioned adjacent a flared nostril portion of a nose of a wearer and said first end and the first and second sides extend towards a bridge of a nose of a wearer.

16. A mask, as defined in claim 14, wherein said first and second sides do not meet said first and second ends at right angles and extend generally diagonally to a dorsum of a wearer of the mask.

17. A mask, as defined in claim 14, wherein each of said second ends of said attachment means is placed adjacent a flared nostril portion of a nose of a wearer and said first end and said first side and said second side extend towards a bridge of a nose of a wearer.

18. A mask, as defined in claim 17, wherein a distance between said first end and second end is greater than a distance between said first side and said second side.

19. A mask, as defined in claim 17, wherein a distance between said first end and said second end is less than a distance between said first and second sides.

20. A mask, as defined in claim 14, wherein said first end of each of said two attachment means are curved.

* * * * *